US005988141A

United States Patent [19]

Uchida

[11] Patent Number: 5,988,141

[45] Date of Patent: Nov. 23, 1999

[54] ENGINE TORQUE CONTROL APPARATUS

[75] Inventor: Masaaki Uchida, Yokosuka, Japan

[73] Assignee: Nissan Motor Co., Ltd., Kanagawa, Japan

[21] Appl. No.: 09/122,649

[22] Filed: Jul. 27, 1998

Related U.S. Application Data

[63] Continuation of application No. 08/804,454, Feb. 21, 1997.

[30] Foreign Application Priority Data

Feb. 23, 1996 [JP] Japan ..... 8-36902

[51] Int. Cl.[6] ..... F02D 41/00; F02D 41/26

[52] U.S. Cl. ..... 123/436; 123/480

[58] Field of Search ..... 123/436, 361, 123/399, 478, 480, 295

[56] References Cited

U.S. PATENT DOCUMENTS

| | | | |
|---|---|---|---|
| 4,763,264 | 8/1988 | Okuno et al. | 123/361 |
| 4,971,011 | 11/1990 | Nanyoshi et al. | 123/350 |
| 5,642,709 | 7/1997 | Ozaki et al. | 123/361 |
| 5,660,157 | 8/1997 | Minowa et al. | 123/436 |
| 5,722,362 | 3/1998 | Takano et al. | 123/295 |
| 5,755,198 | 5/1998 | Grob et al. | 123/295 |
| 5,813,387 | 9/1998 | Minowa et al. | 123/436 |

FOREIGN PATENT DOCUMENTS

| | | |
|---|---|---|
| 62-110536 | 5/1987 | Japan . |
| 1-313636 | 12/1989 | Japan . |

*Primary Examiner*—Willis R. Wolfe
*Assistant Examiner*—Hieu T. Vo
*Attorney, Agent, or Firm*—McDermott, Will & Emery

[57] ABSTRACT

An apparatus for controlling a torque produced from an internal combustion engine operable at an air/fuel ratio. The engine torque control apparatus includes a first control device for controlling an amount of air permitted to enter the engine, and a second control device for controlling an amount of fuel metered to the engine. Target values for the engine torque and air/fuel ratio are calculated based on the sensed engine operating conditions. The first and second control devices are set to control the engine torque to the target value calculated therefor and the air/fuel ratio to the target value calculated therefor.

7 Claims, 13 Drawing Sheets

ENGINE TORQUE CONTROL APPARATUS

This application is a continuation of application Ser. No. 08/804,454 filed Feb. 21, 1997.

BACKGROUND OF THE INVENTION

This invention relates to an apparatus for controlling a torque produced from an internal combustion engine.

For example, Japanese Patent Kokai No. 62-110536 discloses an engine torque control apparatus arranged to calculate a target throttle position from a lookup table which defines the target throttle position as a function of target engine torque and engine speed. This engine torque control is made on an assumption that the air/fuel ratio is fixed at a predetermined value, for example, at the stoichiometric air/fuel ratio. Thus, the conventional apparatus cannot be applied to control the engine torque while changing the air/fuel ratio according to engine operating conditions.

SUMMARY OF THE INVENTION

It is a main object of the invention to provide an engine torque control apparatus which can control the engine torque to a target value while controlling the air/fuel ratio according to engine operating conditions.

There is provided, in accordance with the invention, an apparatus for controlling a torque produced from an internal combustion engine operable at an air/fuel ratio. The engine torque control apparatus comprises sensor means for sensing engine operating conditions, calculation means for calculating target values for the engine torque and air/fuel ratio based on the sensed engine operating conditions, first control means for controlling an amount of air permitted to enter the engine, second control means for controlling an amount of fuel metered to the engine, and a control unit for setting the first and second control means to control the engine torque to the target value calculated therefor and the air/fuel ratio to the target value calculated therefor.

In another aspect of the invention, the engine torque control apparatus comprises sensor means for sensing engine operating conditions including accelerator position, engine speed and intake air flow rate, first control means for rotating the throttle valve to control the amount of air permitted to enter the engine;

second control means for controlling an amount of fuel metered to the engine, means for calculating a reference target intake air flow rate corresponding to a reference air/fuel ratio based on the sensed accelerator position and engine speed, target input air flow rate calculation means for correcting the calculated reference target intake air flow rate based on the sensed accelerator position and engine speed to calculate a target intake air flow rate corresponding to a target air/fuel ratio, a target throttle valve position calculation means for calculating a target throttle valve position based on the calculated target intake air flow rate and the sensed engine speed, target fuel amount calculation means for calculating a target value for the amount of fuel metered to the engine based on the sensed intake air flow rate and engine speed and the target air/fuel ratio, and a control unit for setting the first control means to control the throttle valve to the target position calculated therefor and the second control means to control the amount of fuel metered to the engine to the target value calculated therefor so as to control the engine torque to a target value.

In another aspect of the invention, the engine torque control apparatus comprises sensor means for sensing engine operating conditions including accelerator position, engine speed and intake air flow rate, first control means for rotating the throttle valve to control the amount of air permitted to enter the engine;

second control means for controlling an amount of fuel metered to the engine, means for calculating a target engine torque based on the sensed accelerator position and engine speed, means for calculating a reference target intake air flow rate corresponding to a reference air/fuel ratio based on the calculated target engine torque and the sensed engine speed, target intake air flow rate calculation means for correcting the calculated reference target intake air flow rate based on the sensed accelerator position and engine speed to calculate a target intake air flow rate corresponding to a target air/fuel ratio, a target throttle valve position calculation means for calculating a target throttle valve position based on the calculated target intake air flow rate and the sensed engine speed, target fuel amount calculation means for calculating a target value for the amount of fuel metered to the engine based on the sensed intake air flow rate and engine speed and the target air fuel ratio, and a control unit for setting the first control means to control the throttle valve to the target position calculated therefor and the second control means to control the amount of fuel metered to the engine to the target value calculated therefor so as to control the engine torque to a target value.

In another aspect of the invention, the engine torque control apparatus comprises sensor means for sensing engine operating conditions including accelerator position, engine speed and intake air flow rate, first control means for rotating the throttle valve to control the amount of air permitted to enter the engine, second control means for controlling an amount of fuel metered to the engine, means for specifying a target engine torque, means for calculating a reference target intake air flow rate corresponding to a reference air/fuel ratio based on the specified target engine torque and the sensed engine speed, target intake air flow rate calculation means for correcting the calculated reference target intake air flow rate based on the sensed accelerator position and engine speed to calculate a target intake air flow rate corresponding to a target air/fuel ratio, a target throttle valve position calculation means for calculating a target throttle valve position based on the calculated target intake air flow rate and the sensed engine speed, target fuel amount calculation means for calculating a target value for the amount of fuel metered to the engine based on the sensed intake air flow rate and engine speed and the target air fuel ratio, and a control unit for setting the first control means to control the throttle valve to the target position calculated therefor and the second control means to control the amount of fuel metered to the engine to the target value calculated therefor so as to control the engine torque to a target value.

In another aspect of the invention, the engine torque control apparatus comprises sensor means for sensing engine operating conditions including accelerator position, engine speed and intake air flow rate, first control means for rotating the throttle valve to control the amount of air permitted to enter the engine, second control means for controlling an amount of fuel metered to the engine, means for calculating a target intake air flow rate corresponding to a target air/fuel ratio based on the sensed accelerator position and engine speed, means for calculating a target throttle valve position based on the calculated target intake air flow rate and the sensed engine speed, means for calculating a target value for the amount of fuel metered to the engine based on the sensed intake air flow rate and engine speed and the target air/fuel ratio, and a control unit for setting the first control means to control the throttle valve to the target position calculated therefor and the second control means to control the amount of fuel metered to the engine to the target value calculated therefor so as to control the engine torque to a target value.

In another aspect of the invention, the engine torque control apparatus comprises sensor means for sensing engine operating conditions including accelerator position, engine speed and intake air flow rate, first control means for rotating the throttle valve to control the amount of air permitted to enter the engine, second control means for controlling an amount of fuel metered to the engine, means for calculating a target engine torque based on the sensed accelerator position and engine speed, means for calculating a target intake air flow rate corresponding to a target air/fuel ratio based on the calculated engine torque and the sensed engine speed, means for calculating a target throttle valve position based on the calculated target intake air flow rate and the sensed engine speed, means for calculating a target value for the amount of fuel metered to the engine based on the sensed intake air flow rate and engine speed and the target air/fuel ratio, and a control unit for setting the first control means to control the throttle valve to the target position calculated therefor and the second control means to control the amount of fuel metered to the engine to the target value calculated therefor so as to control the engine torque to a target value.

In another aspect of the invention, the engine torque control apparatus comprises sensor means for sensing engine operating conditions including accelerator position, engine speed and intake air flow rate, first control means for rotating the throttle valve to control the amount of air permitted to enter the engine, second control means for controlling an amount of fuel metered to the engine, means for specifying a target engine torque, means for calculating a reference target intake air flow rate corresponding to a reference air/fuel ratio based on the specified target engine torque and the sensed engine speed, means for calculating a target throttle valve position based on the calculated target intake air flow rate and the sensed engine speed, means for calculating a target value for the amount of fuel metered to the engine based on the sensed intake air flow rate and engine speed and the target air/fuel ratio, and a control unit for setting the first control means to control the throttle valve to the target position calculated therefor and the second control means to control the amount of fuel metered to the engine to the target value calculated therefor so as to control the engine torque to a target value.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
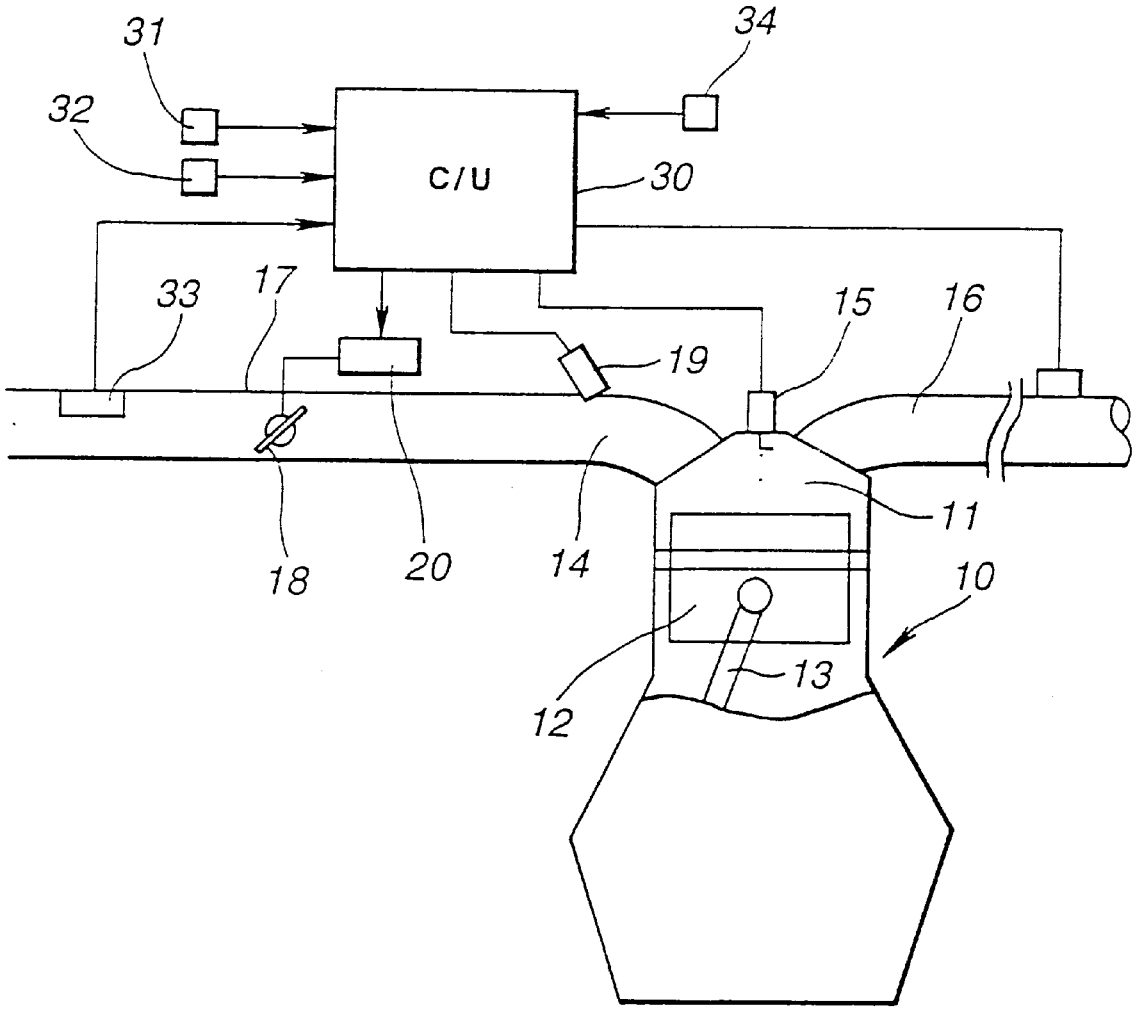
FIG. 1 is a schematic diagram showing one embodiment of an engine torque control apparatus made in accordance with the invention.

With reference to the drawings and in particular to FIG. 1, there is shown a schematic diagram of an engine torque control apparatus embodying the invention. An internal combustion engine, generally designated by the numeral 10, for an automotive vehicle includes combustion chambers or cylinders, one of which is illustrated at 11. A piston 12 is mounted for reciprocal motion within the cylinder 11. A crankshaft (not shown) is supported for rotation within the cylinder 11. A connecting rod 13, which is pivotally connected to the piston 12 and the crankshaft, is used to produce rotation of the crankshaft in response to reciprocation of the piston within the cylinder 11. An intake manifold 14 is connected with the cylinder 11 through an intake port with which an intake valve is in cooperation for regulating an entry of combustion ingredients into the cylinder 11. A spark plug 15 is mounted in the top of the cylinder 11 for igniting the combustion ingredients within the cylinder 11 when the spark plug 15 is energized by the presence of high voltage electrical energy from an engine control unit 30. An exhaust manifold 16 is connected with the cylinder 11 through an exhaust port with which an exhaust valve is in cooperation for regulating the exit of combustion products, exhaust gases, from the cylinder 11 into the exhaust manifold 16. The intake and exhaust valves are driven through a suitable linkage with the crankshaft. Air to the engine 10 is supplied through an induction passage 17. The amount of air permitted to enter the combustion chamber 11 through the intake manifold 14 is controlled by a butterfly throttle valve 18 situated within the induction passage 17. The throttle valve 18 is connected by a mechanical linkage to a throttle valve drive circuit 20 which operates on a command from the engine control unit 30 to control the degree of opening of the throttle valve 18 in response to a demand from an accelerator device such for example as an accelerator pedal.

In the operation of the engine, fuel is injected through the fuel injector 19 toward the intake port of the cylinder 11 and mixed with the air therein. When the intake valve opens, the air-fuel mixture enters the combustion chamber 11. An upward stroke of the piston compresses the air-fuel mixture, which is then ignited by a spark produced by the spark plug 15 in the combustion chamber 11. Combustion of the air-fuel mixture in the combustion chamber 11 takes place, releasing heat energy, which is converted into mechanical energy upon the power stroke of the piston. At or near the end of the power stroke, the exhaust valve opens and the exhaust gases are discharged into the exhaust manifold 16.

The amount of fuel metered to the engine, this being determined by the width of the electrical pulses applied to the fuel injector 19, the amount of air permitted to enter the engine 10, this being determined by the degree to which the throttle valve 18 opens, and the ignition-system spark timing are respectively determined to control the engine output torque from calculations performed in the engine control unit 30. These calculations are made based on various conditions of the engine 10 that are sensed during its operation. These sensed conditions include accelerator position APS, engine speed Ne, intake air flow rate Q, cylinder-head coolant temperature Tw. Thus, an accelerator position sensor 31, a crankshaft position sensor 32, an airflow meter 33 and a cylinder-head coolant temperature sensor 34 are connected to the engine control unit 30. The accelerator position sensor 31 is provided to produce an analog signal corresponding to the amount APS of depression of an accelerator pedal (not shown), that is, the operator's demanded engine load or torque. Preferably, the accelerator position sensor 31 includes a potentiometer connected between a voltage source and electrical ground. The resistance of the potentiometer is a function of the extent to which the accelerator pedal is depressed. The wiper arm of the potentiometer is operatively connected to the accelerator pedal to change the resistance value of the potentiometer as the accelerator pedal moves between its fully released and depressed positions. The crankshaft position sensor produces a series of crankshaft position electrical pulses of a repetition rate directly proportional to the engine speed Ne. The airflow meter 33 comprises a thermosensitive wire placed in the induction passage 17 upstream of the throttle valve 18 and it produces an analog signal proportional to the intake air flow rate Q (the amount of air permitted to enter the engine 10 per unit time). The cylinder-head coolant temperature sensor 34 preferably is mounted in the engine cooling system and it comprises a thermistor connected in an electrical circuit capable of producing a DC voltage having a variable level proportional to coolant temperature Tw.

Figure 2:
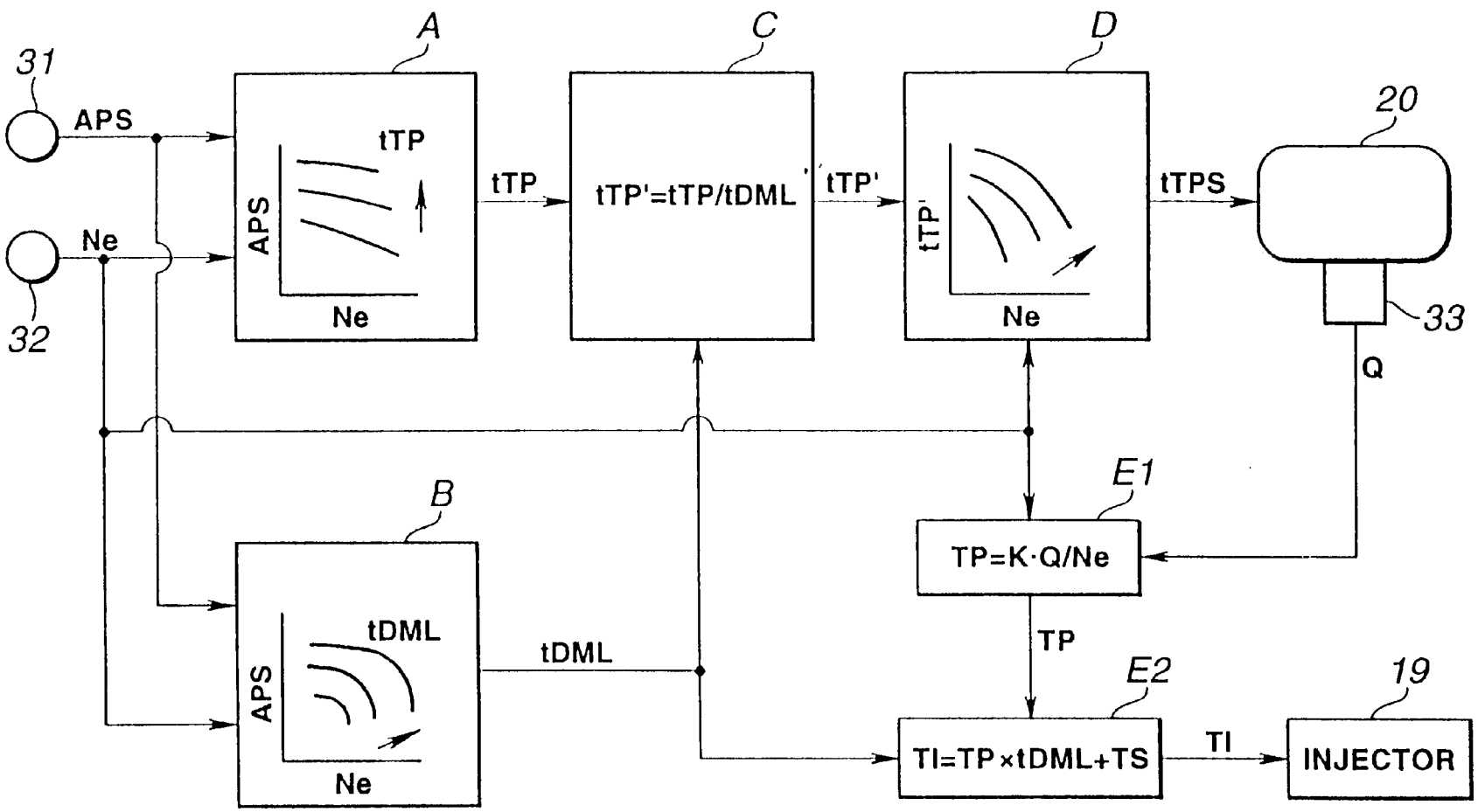
FIG. 2 is a block diagram showing a preferable form of the control unit used in the engine torque control apparatus of FIG. 1.

Referring to FIG. 2, the control unit 30 uses the sensed accelerator position (demanded engine torque) APS and engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of accelerator position APS and engine speed Ne, as shown in the block A of FIG. 2. The reference target intake air flow rate tTP may be the basic fuel-injection pulse-width corresponding to the amount of air introduced into an engine cylinder during each intake stroke or the amount Q of air permitted to enter the engine per unit time. The control unit 30 also uses the sensed accelerator position APS and engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of accelerator position APS and engine speed Ne, as shown in the block B of FIG. 2. The target equivalent ratio tDML may be corrected for the sensed coolant temperature Tw. The control unit 30 calculates a target intake air flow rate tTP' corresponding to a target air/fuel ratio by dividing the calculated reference target intake air flow rate tTP by the calculated target equivalent ratio tDML, as shown in the block C of FIG. 2. The target intake air flow rate tTP' corresponds to the intake air flow rate determined to obtain a target engine torque at the target air/fuel ratio. The control unit 30 calculates a target throttle valve position tTPS as a function of target intake air flow rate tTP' and engine speed Ne, as shown in the block D of FIG. 2. The calculated target throttle valve position tTPS is transferred to the throttle valve drive unit 20 which thereby moves the throttle valve 18 to the calculated position tTPS so as to achieve the target intake air flow rate tTP'. The control unit 30 uses the sensed engine speed Ne and intake air flow rate Q to calculate a basic value TP for fuel-injection pulse-width as $TP=k\cdot Q/Ne$, as shown in the block E1 of FIG. 2, where k is a constant, Q is the intake air flow rate and Ne is the engine speed. The control unit 30 calculates the effective value TE for fuel-injection pulse-width by multiplying the calculated basic value TP by the calculated target equivalent ratio tDML and then calculate an eventual value TI for fuel-injection pulse-width by adding an ineffective pulse-width TS to the effective fuel-injection pulse-width value TE, as shown in the block E2 of FIG. 2. The calculated eventual value TI is transferred to set the fuel-injection pulse-width according to the calculated eventual value TI to operate the fuel injector 19 so as to inject fuel in such an amount as to achieve the target air/fuel ratio.

According to the invention, the amount of air permitted to enter the engine per unit time is controlled to a target value calculated therefor and also the amount of fuel metered to the engine is controlled to a target value calculated therefor. It is, therefore, possible to provide a required engine torque while maintaining a target air/fuel ratio so as to realize desired operating performance.

Since the reference target intake air flow rate at which the target engine torque can be obtained at the reference air/fuel ratio is calculated and then corrected in calculating the target intake air flow rate used to obtain the target engine torque at the target air/fuel ratio, it is possible to reduce the number of the data required for the calculation to a great extent. That is, the lookup data defining reference target intake air flow rate values specified by different pair of demanded engine torque and engine speed has a small dynamic range. Assuming now that the lookup data include 256 (=16×16) reference target intake air flow rate values for different engine operating conditions specified by 16 different demanded engine torque values and 16 different engine speed values, the invention requires 272 (=256+16) data with the use of the 16 target equivalent ratio values. Without the use of the target equivalent ratio values described in connection with the block B of FIG. 2, 4096 (=256×16) data will be required for the same purpose. Furthermore, it is possible to correct the calculated reference target intake air flow rate value simply by dividing it by the target equivalent ratio.

Figure 3:
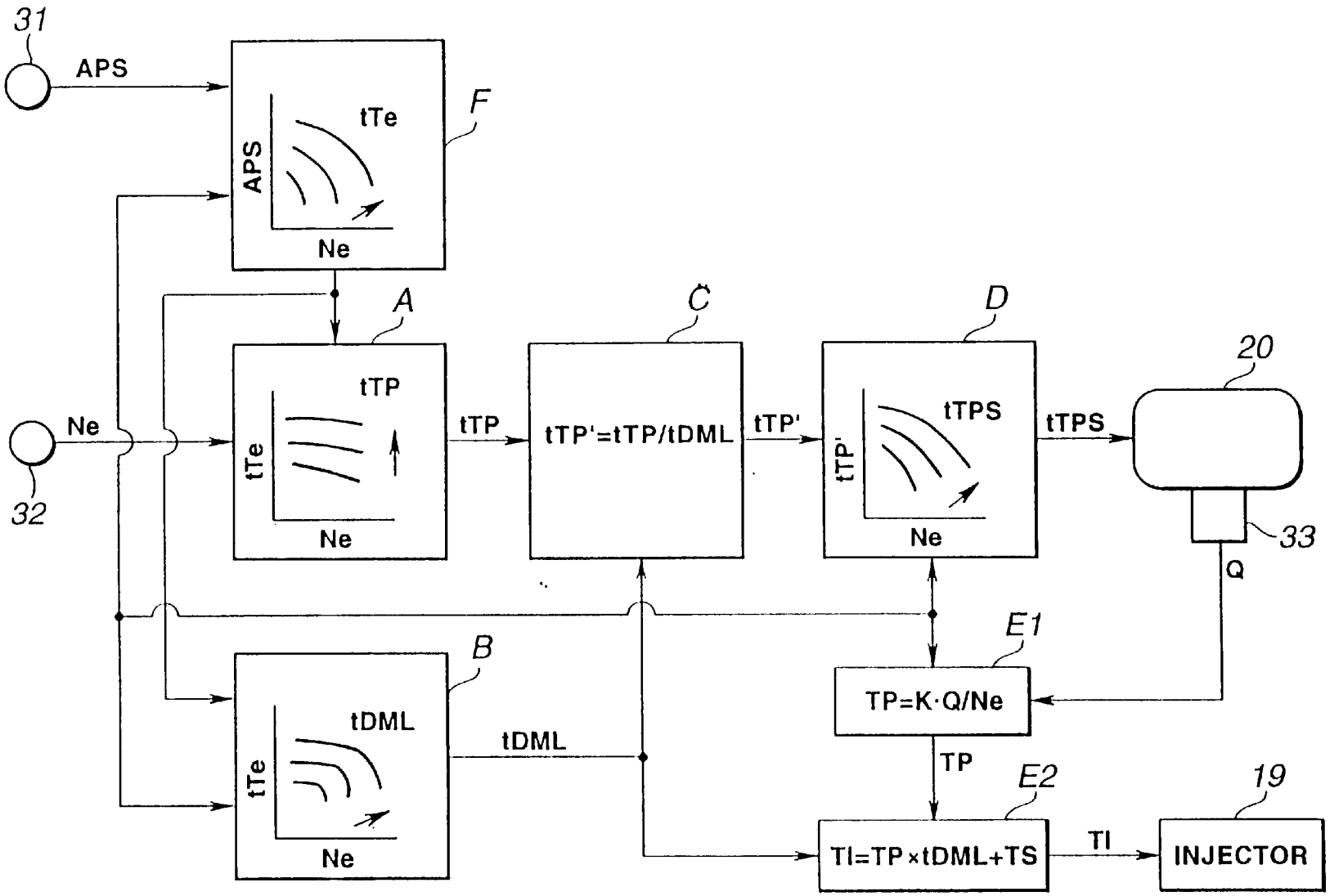
FIG. 3 is a block diagram showing a modified form of the control unit.

Referring to FIG. 3, there is shown another modified form of the control unit 30. In this modification, the control unit 30 uses the sensed accelerator position (demanded engine torque) APS and engine speed Ne to calculate a target engine torque tTe from lookup data stored therein. The lookup data, which may be obtained experimentally, specify the target engine torque tTe as a function of accelerator position APS and engine speed Ne, as shown in the block F of FIG. 3. Although the target engine torque tTe has been described as calculated as a function of demanded engine torque APS and engine speed Ne, it is to be understood that the target engine torque tTe may be specified or commanded externally by the operator through an input device. The control unit 30 uses the calculated target engine torque tTe and the sensed engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of target engine torque tTe and engine speed Ne, as shown in the block A of FIG. 3. The control unit 30 also uses the calculated target engine torque tTe and the sensed engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of target engine torque the and engine speed Ne, as shown in the block B of FIG. 3. The target equivalent ratio tDML may be corrected for the sensed coolant temperature Tw. The control unit 30 calculates a target intake air flow rate tTP' corresponding to a target air/fuel ratio by dividing the calculated reference target intake air flow rate tTP by the calculated target equivalent ratio tDML, as shown in the block C of FIG. 3. The target intake air flow rate tTP' corresponds to the intake air flow rate determined to obtain a target engine torque at the target air/fuel ratio. The control unit 30 calculates a target throttle valve position tTPS as a function of target intake air flow rate tTP' and engine speed Ne, as shown in the block D of FIG. 3. The calculated target throttle valve position tTPS is transferred to the throttle valve drive unit 20 which thereby moves the throttle valve 18 to the calculated position tTPS so as to achieve the target intake air flow rate tTP'. The control unit 30 uses the sensed engine speed Ne and intake air flow rate Q to calculate a basic value TP for fuel-injection pulse-width as TP=k·Q/Ne, as shown in the block E1 of FIG. 3, where k is a constant, Q is the intake air flow rate and Ne is the engine speed. The control unit 30 calculates the effective value TE for fuel-injection pulse-width by multiplying the calculated basic value TP by the calculated target equivalent ratio tDML and then calculate an eventual value TI for fuel-injection pulse-width by adding an ineffective pulse-width TS to the effective fuel-injection pulse-width value TE, as shown in the block E2 of FIG. 3. The calculated eventual value TI is transferred to set the fuel-injection pulse-width according to the calculated eventual value TI to operate the fuel injector 19 so as to inject fuel in such an amount as to achieve the target air/fuel ratio.

Figure 4:
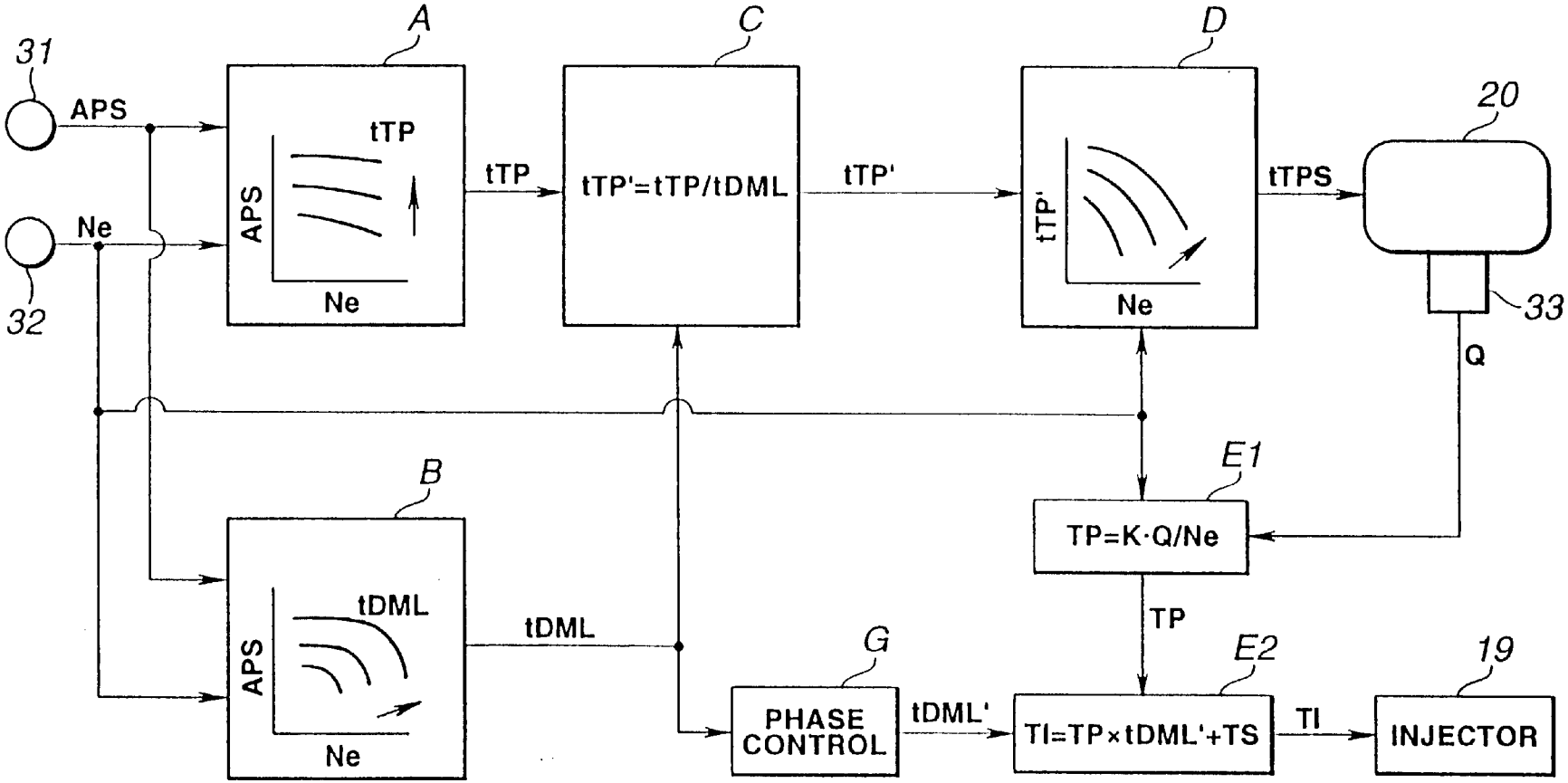
FIG. 4 is a block diagram showing another modified form of the control unit.

Referring to FIG. 4, there is shown another modified form of the control unit 30. In this modification, the control unit 30 uses the sensed accelerator position (demanded engine torque) APS and engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of accelerator position APS and engine speed Ne, as shown in the block A of FIG. 4. The reference target intake air flow rate tTP may be the basic fuel-injection pulse-width corresponding to the amount of air introduced into an engine cylinder during each intake stroke or the amount Q of air permitted to enter the engine per unit time. The control unit 30 also uses the sensed accelerator position APS and engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of accelerator position APS and engine speed Ne, as shown in the block B of FIG. 4. The target equivalent ratio tDML may be corrected for the sensed coolant temperature Tw. The control unit 30 calculates a target intake air flow rate tTP' corresponding to a target air/fuel ratio by dividing the calculated reference target intake air flow rate tTP by the calculated target equivalent ratio tDML, as shown in the block C of FIG. 4. The target intake air flow rate tTP' corresponds to the intake air flow rate determined to obtain a target engine torque at the target air/fuel ratio. The control unit 30 calculates a target throttle valve position tTPS as a function of target intake air flow rate tTP' and engine speed Ne, as shown in the block D of FIG. 4. The calculated target throttle valve position tTPS is transferred to the throttle valve drive unit 20 which thereby moves the throttle valve 18 to the calculated position tTPS so as to achieve the target intake air flow rate tTP'. The control unit 30 includes a block G which produces a second target equivalent ratio tDML' having its phase delayed with respect to the target equivalent ratio tDML calculated in the block B of FIG. 4. For this purpose, the control unit calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 4, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 4. The calculated eventual value TI is transferred to set the fuel-injection pulse-width according to the calculated eventual value TI to operate the fuel injector 19 so as to inject fuel in such an amount as to achieve the target air/fuel ratio.

Figure 5:
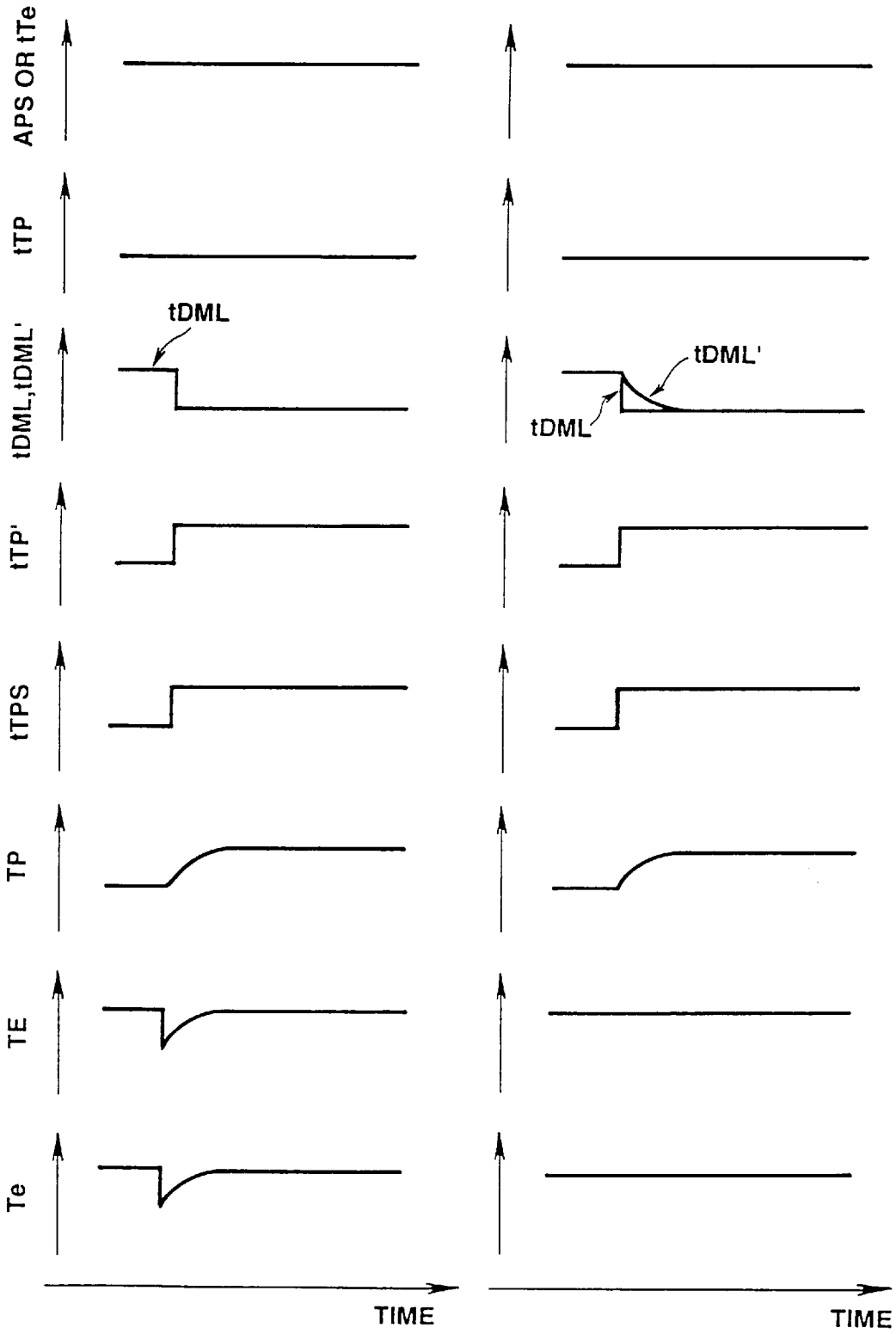
FIG. 5 contains graphs used in explaining the effect of the phase control used for the engine torque control of the control unit of FIG. 4.

This modification can keep the actual engine torque Te free from disturbances which may occur when the air/fuel ratio changes by changing the amount of fuel metered into the engine according to the second target equivalent ratio tDML' delayed with respect to the target equivalent ratio tDML, that is, corresponding to the delay of the intake air flow rate in responding to a change in the air/fuel ratio. It is now assumed that the target air/fuel ratio is leaned when the accelerator position APS or demanded engine torque tTe is unchanged, as shown in FIG. 5. Since the accelerator position APS or the demanded engine torque tTe is constant, the reference target intake air flow rate tTP, that is, the intake air flow rate required at the stoichiometric air/fuel ratio, is constant. The target equivalent ratio tDML, that is, the ratio of the stoichiometric air/fuel ratio to the target air/fuel ratio, decreases as the target air/fuel ratio is leaned. As a result, the target intake air flow rate tTP' corresponding to the target air/fuel ratio tTP/tDML increases and the target throttle position tTPS increases. Since the intake air change is delayed according to the volume of the intake air system, the basic fuel-injection pulse-width value TP increases after a delay. Because of this, the effective fuel-injection pulse-width value TE (=TP×tDML) decreases temporarily, causing a temporary decrease in the actual engine torque. It is possible to keep the actual engine torque free from such a temporary decrease by calculating the effective fuel-injection pulse-width value TE as TE=TP×tDML' since the second target equivalent ratio tDML' is in phase of the intake air response delay.

Figure 6:
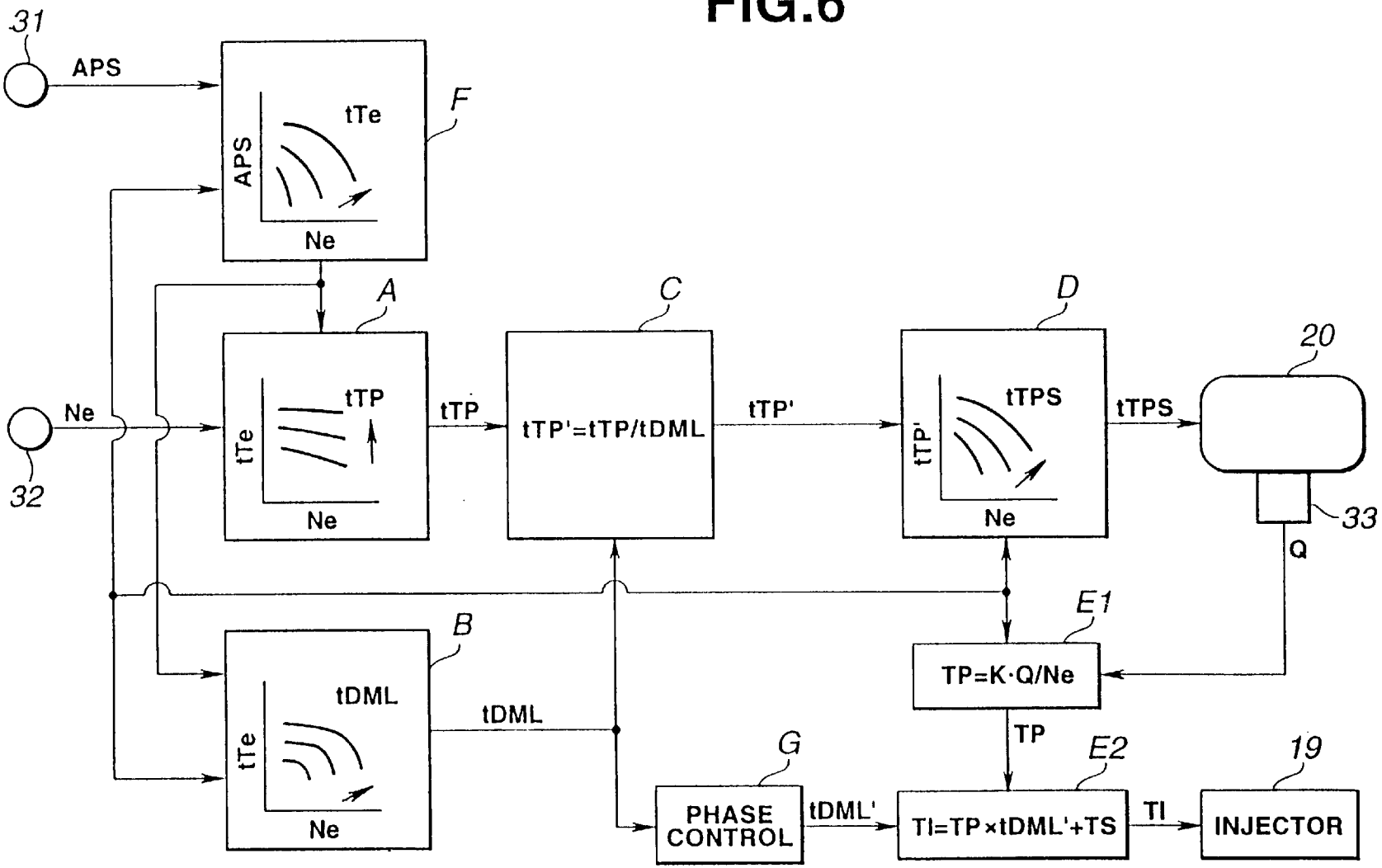
FIG. 6 is a block diagram showing another modified form of the control unit.

Referring to FIG. 6, there is shown another modified form of the control unit 30. In this modification, the control unit 30 uses the sensed accelerator position (demanded engine torque) APS and engine speed Ne to calculate a target engine torque tTe from lookup data stored therein. The lookup data, which may be obtained experimentally, specify the target engine torque tTe as a function of accelerator position APS and engine speed Ne, as shown in the block F of FIG. 6. The control unit 30 uses the calculated target engine torque tTe and the sensed engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of target engine torque tTe and engine speed Ne, as shown in the block A of FIG. 6. The control unit 30 also uses the calculated target engine torque tTe and the sensed engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of target engine torque tTe and engine speed Ne, as shown in the block B of FIG. 6. The target equivalent ratio tDML may be corrected for the sensed coolant temperature Tw. The control unit 30 calculates a target intake air flow rate tTP' corresponding to a target air/fuel ratio by dividing the calculated reference target intake air flow rate tTP by the calculated target equivalent ratio tDML, as shown in the block C of FIG. 6. The target intake air flow rate tTP' corresponds to the intake air flow rate determined to obtain a target engine torque at the target air/fuel ratio. The control unit 30 calculates a target throttle valve position tTPS as a function of target intake air flow rate tTP' and engine speed Ne, as shown in the block D of FIG. 6. The calculated target throttle valve position tTPS is transferred to the throttle valve drive unit 20 which thereby moves the throttle valve 18 to the calculated position tTPS so as to achieve the target intake air flow rate tTP'. The control unit 30 includes a block G which produces a second target equivalent ratio tDML' having its phase delayed with respect to the target equivalent ratio tDML calculated in the block B of FIG. 6. For this purpose, the control unit 30 calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 6, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 6. The calculated eventual value TI is transferred to set the fuel-injection pulse-width according to the calculated eventual value TI to operate the fuel injector 19 so as to inject fuel in such an amount as to achieve the target air/fuel ratio.

Figure 7:
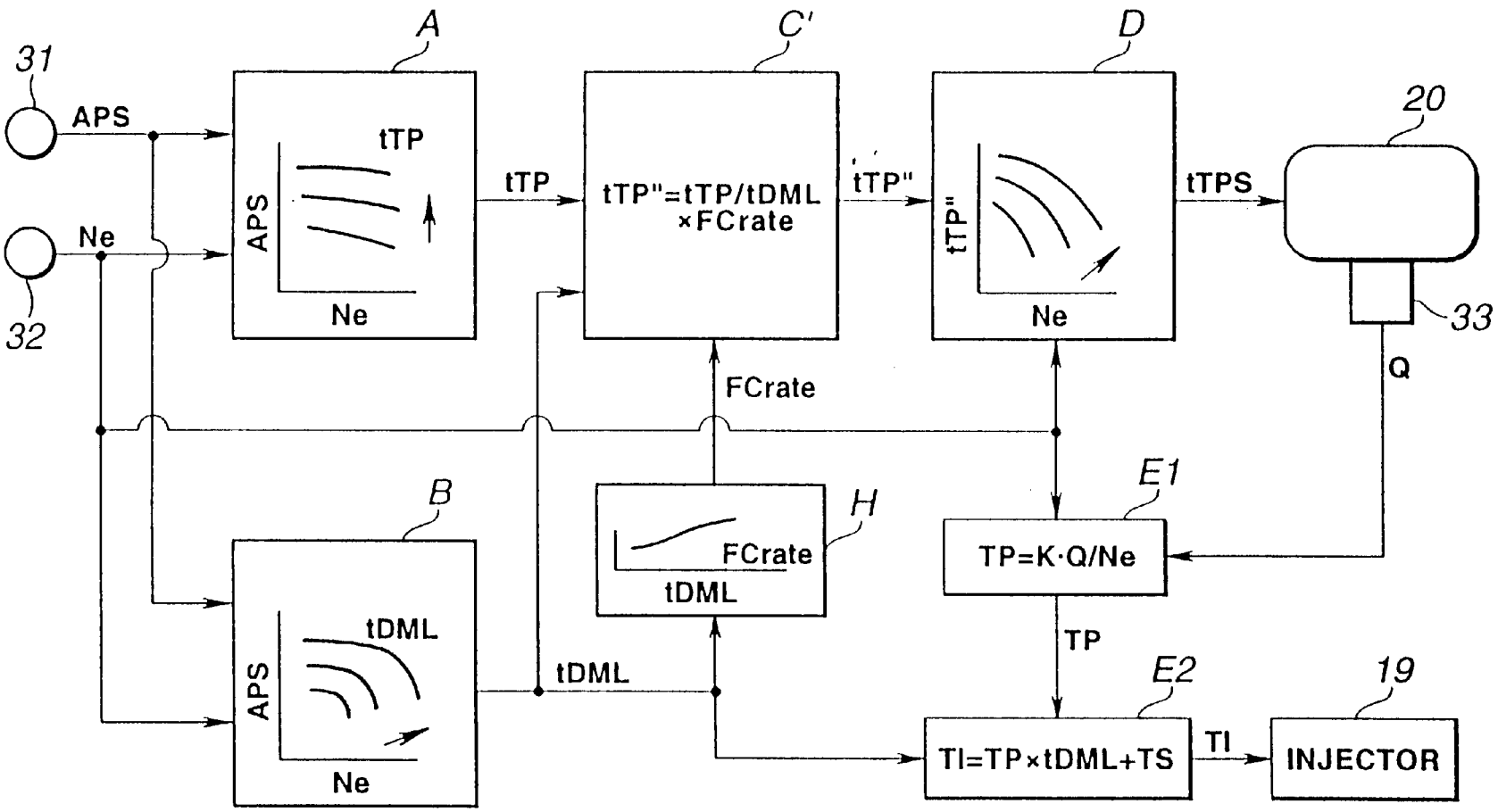
FIG. 7 is a block diagram showing another modified form of the control unit.

Referring to FIG. 7, there is shown another modified form of the control unit 30. In this modification, the control unit 30 uses the sensed accelerator position (demanded engine torque) APS and engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of accelerator position APS and engine speed Ne, as shown in the block A of FIG. 7. The reference target intake air flow rate tTP may be the basic fuel-injection pulse-width corresponding to the amount of air introduced into an engine cylinder during each intake stroke or the amount Q of air permitted to enter the engine per unit time. The control unit 30 also uses the sensed accelerator position APS and engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of accelerator position APS and engine speed Ne, as shown in the block B of FIG. 7. The target equivalent ratio tDML may be corrected for the sensed coolant temperature Tw.

The control unit 30 calculates a fuel consumption rate correction factor FCrate from data stored therein in the form of a lookup table. The lookup data specify the fuel consumption rate correction factor FCrate as a function of target equivalent ratio tDML, as shown in the block H of FIG. 7. The control unit 30 calculates a target intake air flow rate tTP[|m]K corresponding to a target air/fuel ratio as tTP"= tTP/tDML×FCrate where tTP is the calculated reference target intake air flow rate, tDML is the calculated target equivalent ratio tDML and FCrate is the calculated fuel consumption rate correction factor, as shown in the block C' of FIG. 7. The target intake air flow rate tTP" corresponds to the intake air flow rate determined to obtain a target engine torque at the target air/fuel ratio. The control unit 30 calculates a target throttle valve position tTPS as a function of target intake air flow rate tTP" and engine speed Ne, as shown in the block D of FIG. 7. The calculated target throttle valve position tTPS is transferred to the throttle valve drive unit 20 which thereby moves the throttle valve 18 to the calculated position tTPS so as to achieve the target intake air flow rate tTP".

Figure 8:
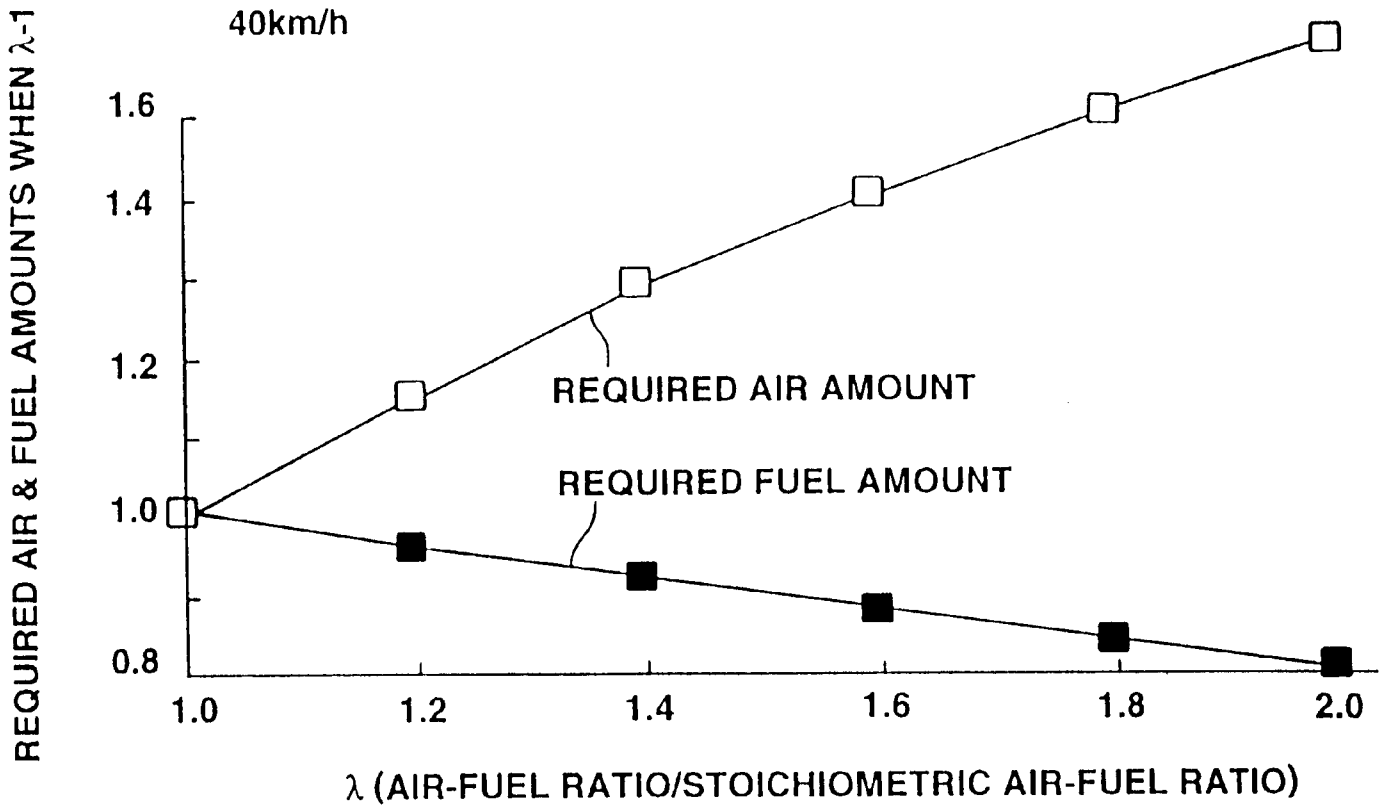
FIG. 8 is a graph used in explaining the effect of the fuel consumption rate correction factor used for the engine torque control of the control unit of FIG. 8.

Although the amount of fuel required to be metered into the engine so as to produce the same engine torque is substantially constant regardless of the air/fuel ratio, the required fuel amount decreases as the air/fuel ratio increases since the fuel consumption rate is improved when the air/fuel ratio is leaned, as shown in FIG. 8. For this reason, it is possible to correct the target intake air flow rate tTP' (see FIG. 2) according to the degree to which the fuel consumption rate is improved when the air/fuel ratio is leaned by multiplying the fuel consumption rate correction factor FCrate by the target intake air flow rate tTP'.

The control unit 30 uses the sensed engine speed Ne and intake air flow rate Q to calculate a basic value TP for fuel-injection pulse-width as TP=k·Q/Ne, as shown in the block E1 of FIG. 7, where k is a constant, Q is the intake air flow rate and Ne is the engine speed. The control unit 30 calculates the effective value TE for fuel-injection pulse-width by multiplying the calculated basic value TP by the calculated target equivalent ratio tDML and then calculate an eventual value TI for fuel-injection pulse-width by adding an ineffective pulse-width TS to the effective fuel-injection pulse-width value TE, as shown in the block E2 of FIG. 7. The calculated eventual value TI is transferred to set the fuel-injection pulse-width according to the calculated eventual value TI to operate the fuel injector 19 so as to inject fuel in such an amount as to achieve the target air/fuel ratio.

In this modification, it is possible to stabilize the engine torque with higher accuracy when the target air/fuel ratio is changing. It is to be understood that the fuel consumption rate correction factor FCrate may be corrected based on the reference intake air flow rate tTP, the engine speed Ne, the coolant temperature Tw or the like.

Figure 9:
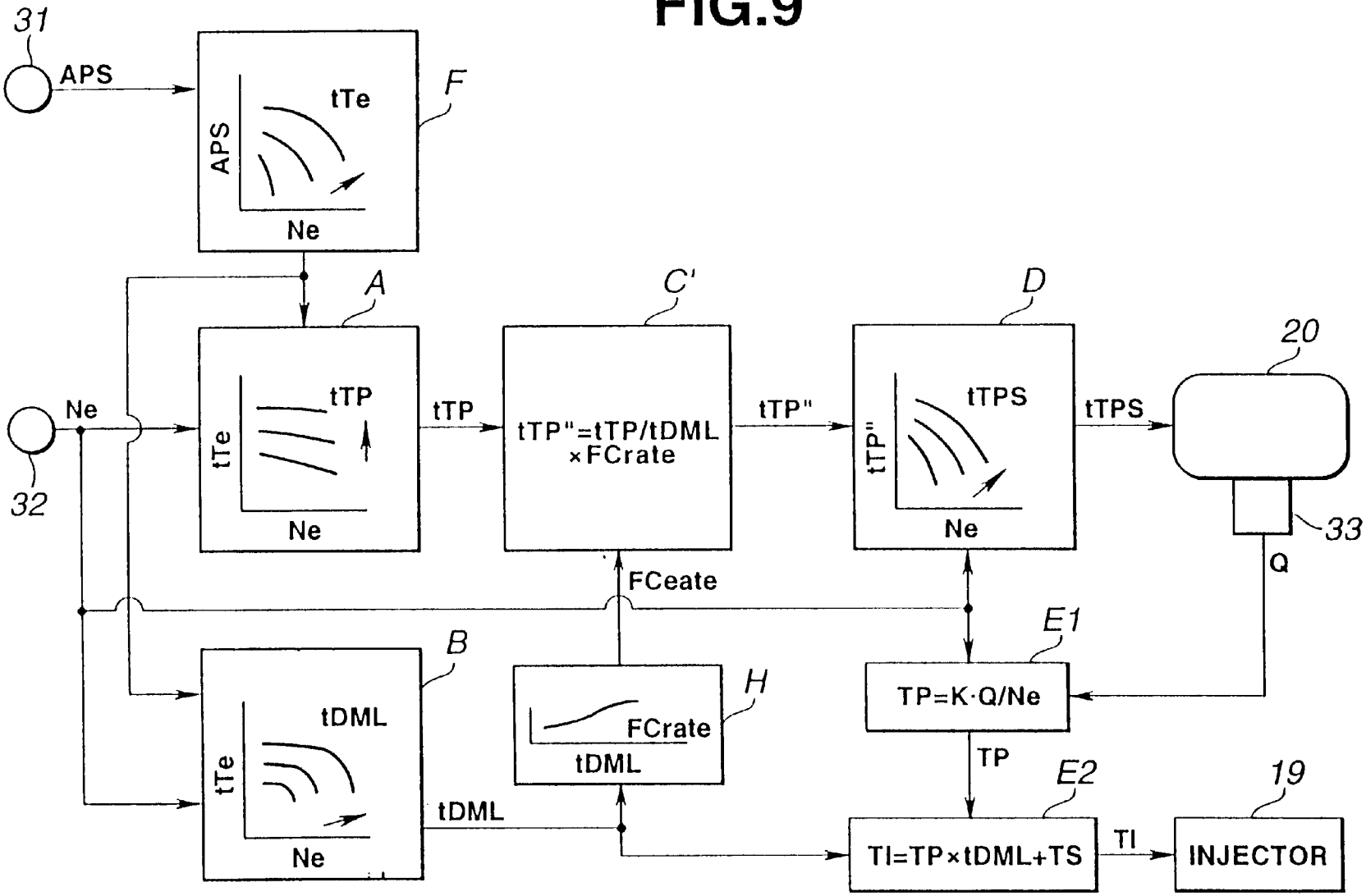
FIG. 9 is a block diagram showing another modified form of the control unit.

Referring to FIG. 9, there is shown another modified form of the control unit 30. In this modification, the the control unit 30 uses the sensed accelerator position (demanded engine torque) APS and engine speed Ne to calculate a target engine torque tTe from lookup data stored therein. The lookup data, which may be obtained experimentally, specify the target engine torque tTe as a function of accelerator position APS and engine speed Ne, as shown in the block F of FIG. 9. The control unit 30 uses the calculated target engine torque tTe and the sensed engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of target engine torque tTe and engine speed Ne, as shown in the block A of FIG. 9. The control unit 30 also uses the calculated target engine torque tTe and the sensed engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of target engine torque tTe and engine speed Ne, as shown in the block B of FIG. 9. The target equivalent ratio tDML may be corrected for the sensed coolant temperature Tw.

The control unit 30 calculates a fuel consumption rate correction factor FCrate from data stored therein in the form of a lookup table. The lookup data specify the fuel consumption rate correction factor FCrate as a function of target equivalent ratio tDML, as shown in the block H of FIG. 9. The control unit 30 calculates a target intake air flow rate tTP" corresponding to a target air/fuel ratio as tTP"=tTP/tDML×FCrate where tTP is the calculated reference target intake air flow rate, tDML is the calculated target equivalent ratio tDML and FCrate is the calculated fuel consumption rate correction factor, as shown in the block C' of FIG. 9. The target intake air flow rate tTP" corresponds to the intake air flow rate determined to obtain a target engine torque at the target air/fuel ratio. The control unit 30 calculates a target throttle valve position tTPS as a function of target intake air flow rate tTP" and engine speed Ne, as shown in the block D of FIG. 9. The calculated target throttle valve position tTPS is transferred to the throttle valve drive unit 20 which thereby moves the throttle valve 18 to the calculated position tTPS so as to achieve the target intake air flow rate tTP".

The control unit 30 uses the sensed engine speed Ne and intake air flow rate Q to calculate a basic value TP for fuel-injection pulse-width as TP=k·Q/Ne, as shown in the block E1 of FIG. 9, where k is a constant, Q is the intake air flow rate and Ne is the engine speed. The control unit 30 calculates the effective value TE for fuel-injection pulse-width by multiplying the calculated basic value TP by the calculated target equivalent ratio tDML and then calculate an eventual value TI for fuel-injection pulse-width by adding an ineffective pulse-width TS to the effective fuel-injection pulse-width value TE, as shown in the block E2 of FIG. 9. The calculated eventual value TI is transferred to set the fuel-injection pulse-width according to the calculated eventual value TI to operate the fuel injector 19 so as to inject fuel in such an amount as to achieve the target air/fuel ratio.

Figure 10:
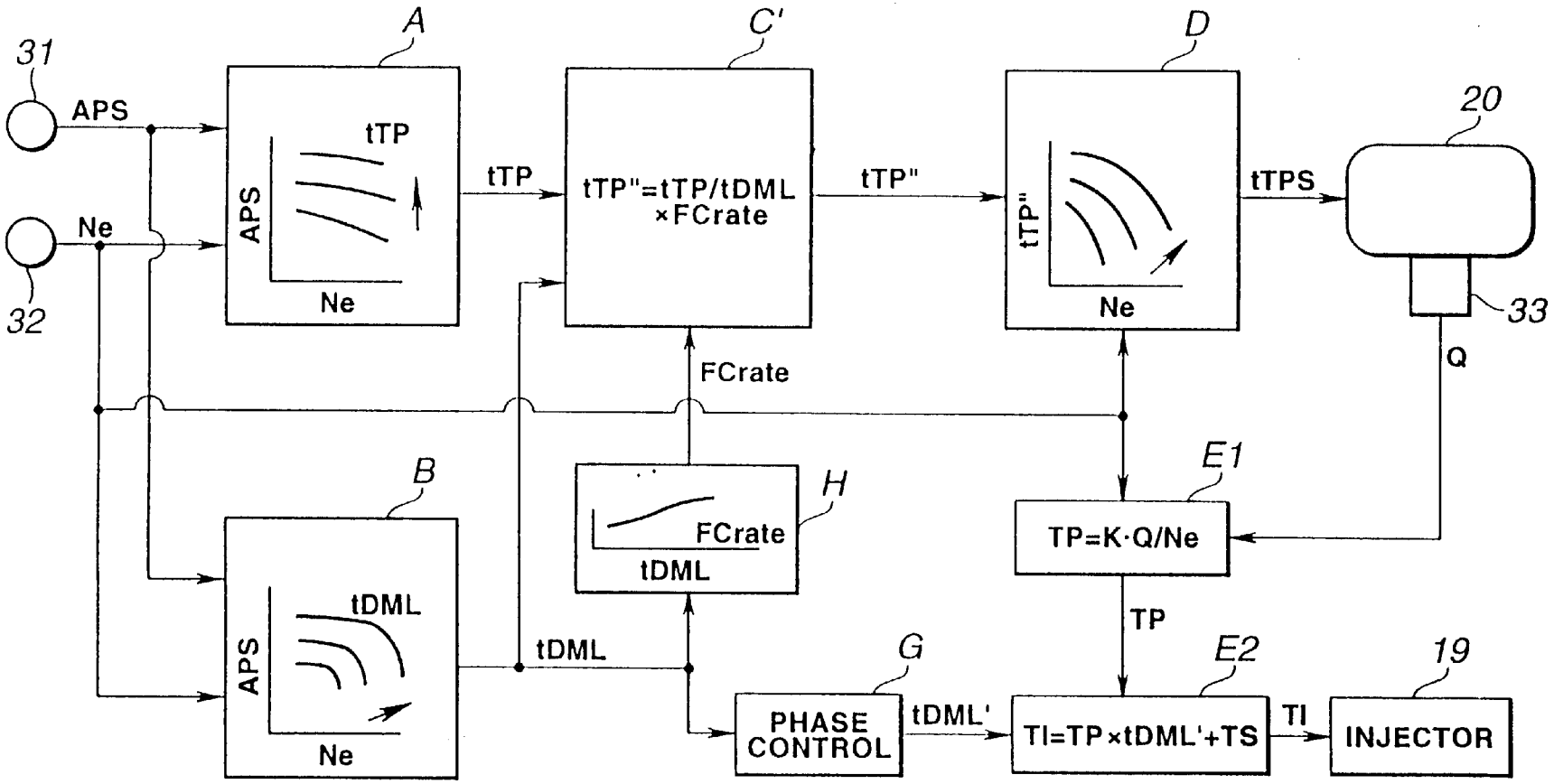
FIG. 10 is a block diagram showing another modified form of the control unit.

Referring to FIG. 10, there is shown another modified form of the control unit 30. In this modification, the control unit 30 uses the sensed accelerator position (demanded engine torque) APS and engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of accelerator position APS and engine speed Ne, as shown in the block A of FIG. 10. The reference target intake air flow rate tTP may be the basic fuel-injection pulse-width corresponding to the amount of air introduced into an engine cylinder during each intake stroke or the amount Q of air permitted to enter the engine per unit time. The control unit 30 also uses the sensed accelerator position APS and engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of accelerator position APS and engine speed Ne, as shown in the block B of FIG. 10. The target equivalent ratio tDML may be corrected for the sensed coolant temperature Tw.

The control unit 30 calculates a fuel consumption rate correction factor FCrate from data stored therein in the form of a lookup table. The lookup data specify the fuel consumption rate correction factor FCrate as a function of target equivalent ratio tDML, as shown in the block H of FIG. 10. The control unit 30 calculates a target intake air flow rate tTP" corresponding to a target air/fuel ratio as tTP"=tTP/tDML×FCrate where tTP is the calculated reference target intake air flow rate, tDML is the calculated target equivalent ratio tDML and FCrate is the calculated fuel consumption rate correction factor, as shown in the block C' of FIG. 10. The target intake air flow rate tTP" corresponds to the intake air flow rate determined to obtain a target engine torque at the target air/fuel ratio. The control unit 30 calculates a target throttle valve position tTPS as a function of target intake air flow rate tTP" and engine speed Ne, as shown in the block D of FIG. 10. The calculated target throttle valve position tTPS is transferred to the throttle valve drive unit 20 which thereby moves the throttle valve 18 to the calculated position tTPS so as to achieve the target intake air flow rate tTP".

The control unit 30 includes a block G which produces a second target equivalent ratio tDML' having its phase delayed with respect to the target equivalent ratio tDML calculated in the block B of FIG. 10. For this purpose, the control unit 30 calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 10, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 10. The calculated eventual value TI is transferred to set the fuel-injection pulse-width according to the calculated eventual value TI to operate the fuel injector 19 so as to inject fuel in such an amount as to achieve the target air/fuel ratio.

Figure 11:
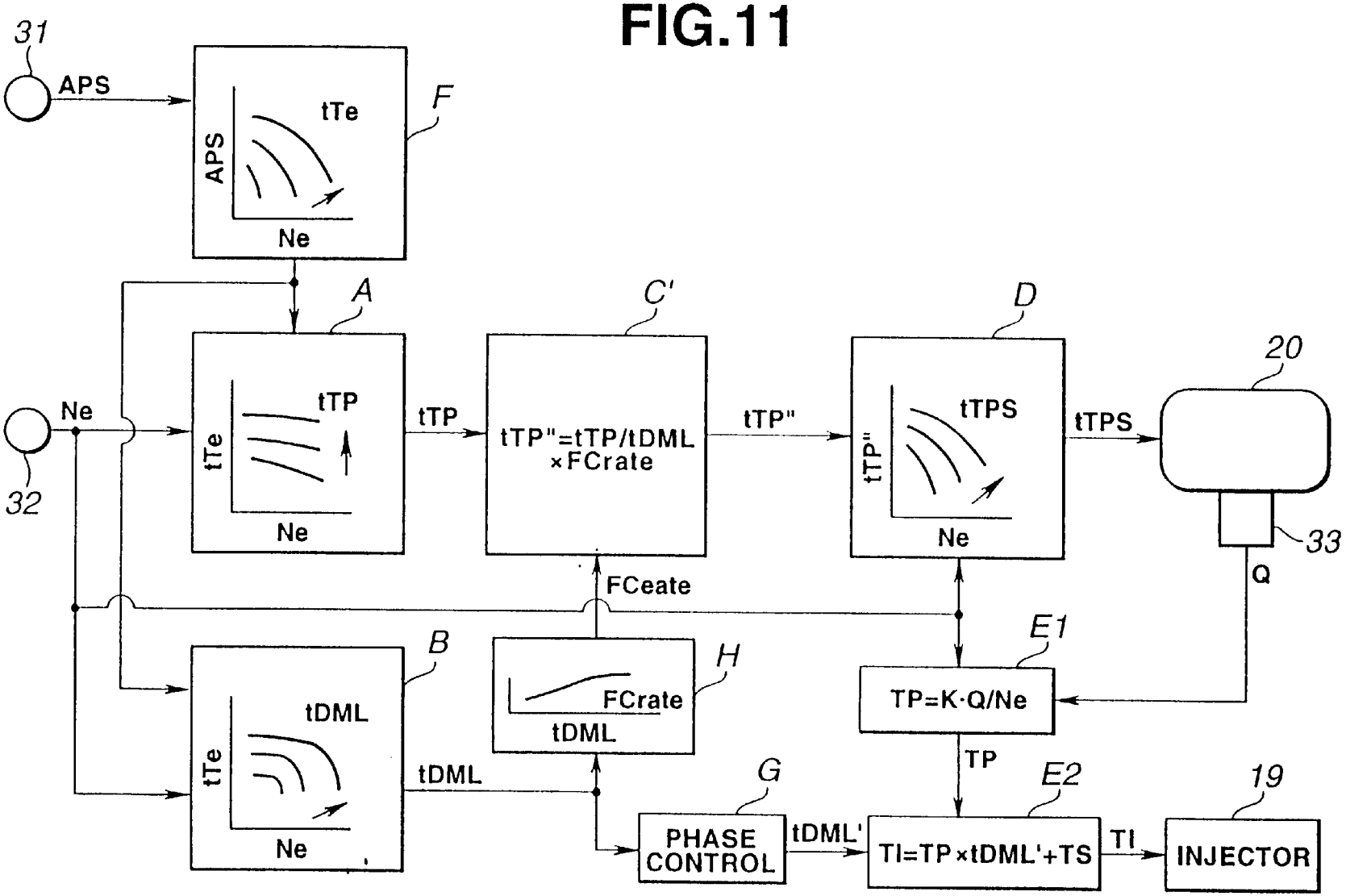
FIG. 11 is a block diagram showing another modified form of the control unit.

Referring to FIG. 11, there is shown another modified form of the control unit 30. In this modification, the control unit 30 uses the sensed accelerator position (demanded engine torque) APS and engine speed Ne to calculate a target engine torque tTe from lookup data stored therein. The lookup data, which may be obtained experimentally, specify the target engine torque tTe as a function of accelerator position APS and engine speed Ne, as shown in the block F of FIG. 11. The control unit 30 uses the calculated target engine torque tTe and the sensed engine speed Ne to calculate a reference target intake air flow rate tTP, which corresponds to an air flow rate at which a target engine torque can be obtained when the air/fuel ratio is at a reference value, for example, the stoichiometric air/fuel ratio, from data stored therein in the form of a lookup table. The lookup data, which may be obtained experimentally, define the reference target intake air flow rate tTP as a function of target engine torque tTe and engine speed Ne, as shown in the block A of FIG. 11. The control unit 30 also uses the calculated target engine torque tTe and the sensed engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of target engine torque tTe and engine speed Ne, as shown in the block B of FIG. 11. The target equivalent ratio tDML may be corrected for the sensed coolant temperature Tw.

The control unit 30 calculates a fuel consumption rate correction factor FCrate from data stored therein in the form of a lookup table. The lookup data specify the fuel consumption rate correction factor FCrate as a function of target equivalent ratio tDML, as shown in the block H of FIG. 11. The control unit 30 calculates a target intake air flow rate tTP" corresponding to a target air/fuel ratio as tTP"=tTP/tDML×FCrate where tTP is the calculated reference target intake air flow rate, tDML is the calculated target equivalent ratio tDML and FCrate is the calculated fuel consumption rate correction factor, as shown in the block C' of FIG. 11. The target intake air flow rate tTP" corresponds to the intake air flow rate determined to obtain a target engine torque at the target air/fuel ratio. The control unit 30 calculates a target throttle valve position tTPS as a function of target intake air flow rate tTP" and engine speed Ne, as shown in the block D of FIG. 9. The calculated target throttle valve position tTPS is transferred to the throttle valve drive unit 20 which thereby moves the throttle valve 18 to the calculated position tTPS so as to achieve the target intake air flow rate tTP".

The control unit 30 includes a block G which produces a second target equivalent ratio tDML' having its phase delayed with respect to the target equivalent ratio tDML calculated in the block B of FIG. 11. For this purpose, the control unit 30 calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 11, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 11. The calculated eventual value TI is transferred to set the fuel-injection pulse-width according to the calculated eventual value TI to operate the fuel injector 19 so as to inject fuel in such an amount as to achieve the target air/fuel ratio.

Figure 12:
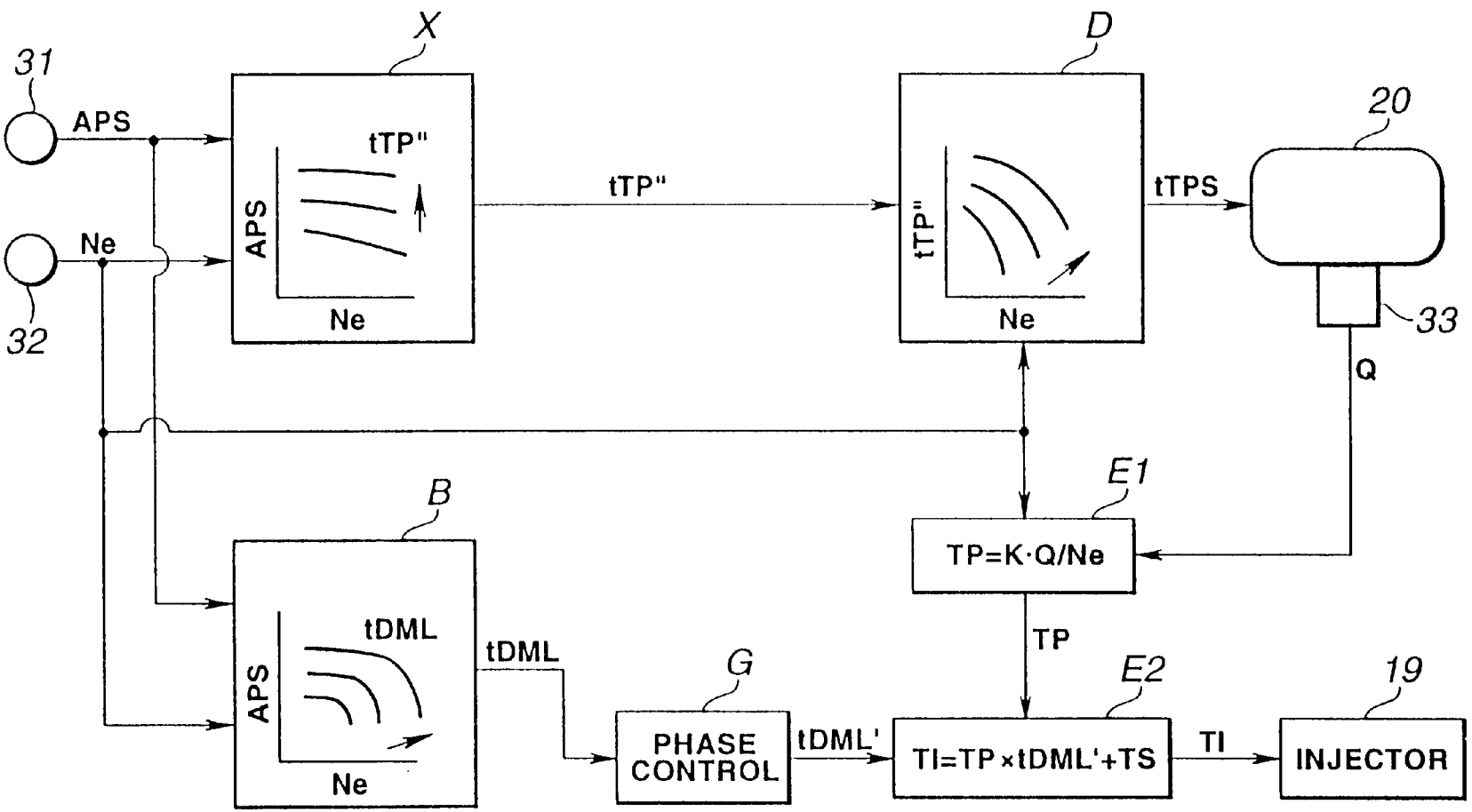
FIG. 12 is a block diagram showing another modified form of the control unit.

Referring to FIG. 12, there is shown another modified form of the control unit 30. In this modification, the control unit 30 uses the sensed accelerator position (demanded engine torque) APS and engine speed Ne to calculate a target intake air flow rate tTP" corresponding to a target air/fuel ratio from data stored therein in the form of a lookup table. The lookup data, which may be obtained experimentally, defines the target intake air flow rate tTP" as a function of demanded engine torque APS and engine speed Ne, as shown in the block X of FIG. 12. It is to be understood that the target intake air flow rate tTP", which corresponds to the intake air flow rate determined to obtain a target engine torque at the target air/fuel ratio, is substantially the same as the target intake air flow rate calculated in the block C' of FIG. 7. The control unit 30 calculates a target throttle valve position tTPS from data stored therein in the form of a lookup table. The lookup data, which may be obtained experimentally, define the target throttle valve position tTPS as a function of target intake air flow rate tTP" and engine speed Ne, as shown in the block D of FIG. 12. The calculated target throttle valve position tTPS is transferred to the throttle valve drive unit 20 which thereby moves the throttle valve 18 to the calculated position tTPS so as to achieve the target intake air flow rate tTP".

The control unit 30 also uses the sensed accelerator position APS and engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of accelerator position APS and engine speed Ne, as shown in the block B of FIG. 12. The target equivalent ratio tDML may be corrected for the sensed coolant temperature Tw.

The control unit 30 includes a block G which produces a second target equivalent ratio tDML' having its phase delayed with respect to the target equivalent ratio tDML calculated in the block B of FIG. 12. For this purpose, the control unit 30 calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 12, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 12. The calculated eventual value TI is transferred to set the fuel-injection pulse-width according to the calculated eventual value TI to operate the fuel injector 19 so as to inject fuel in such an amount as to achieve the target air/fuel ratio.

In this embodiment, the target intake air flow rate tTP" without corrections made based on the calculated target equivalent ratio tDML and fuel consumption rate correction factor FCrate. It is, therefore, possible to reduce the number of calculations required for the engine torque control and increase the accuracy of the data used for the engine torque control.

It is to be understood that the engine control unit 30 may be arranged to perform the engine torque control without the phase control made in the block G of FIG. 12.

Figure 13:
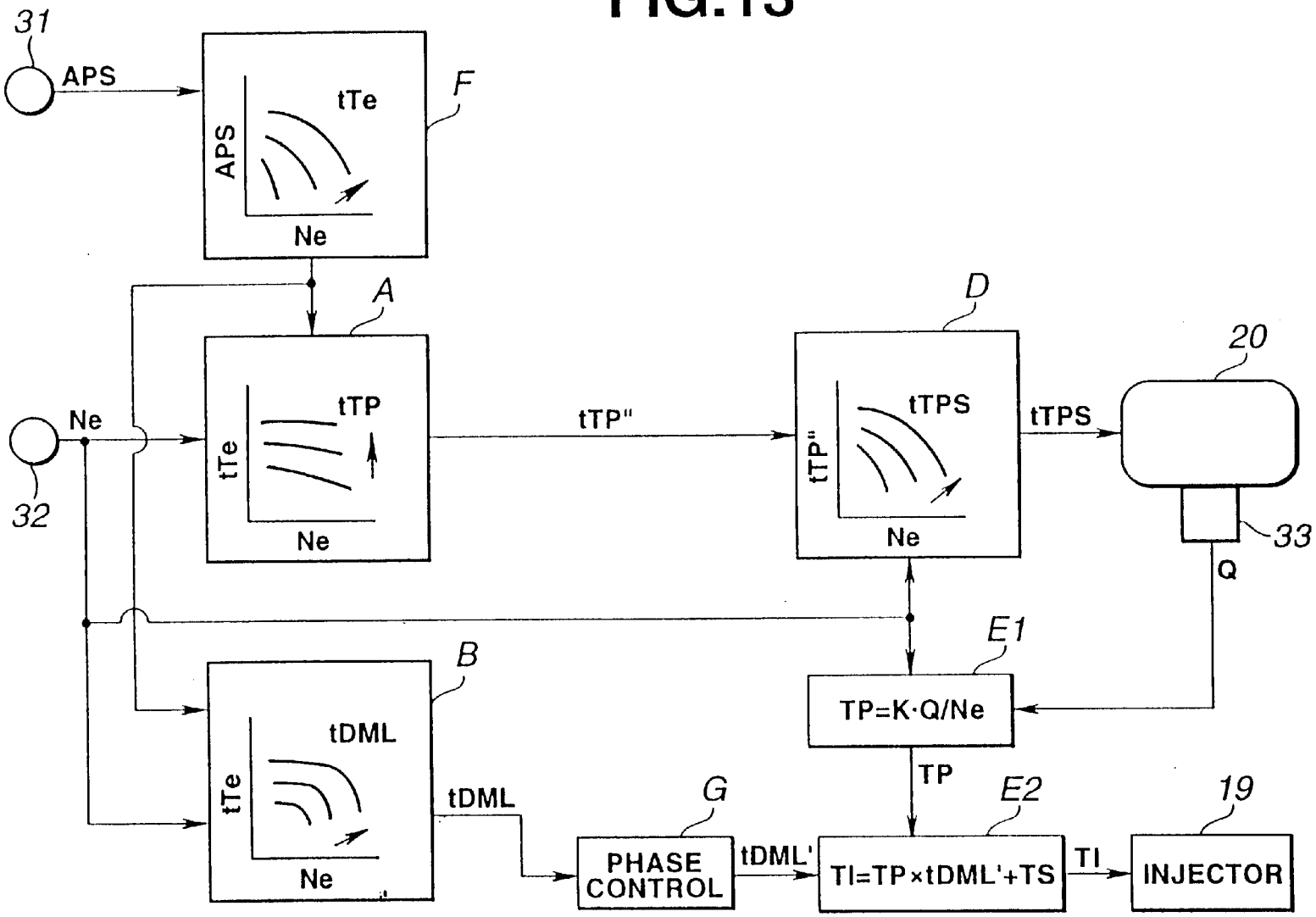
FIG. 13 is a block diagram showing another modified form of the control unit.

Referring to FIG. 13, there is shown another modified form of the control unit 30. In this embodiment, the control unit 30 uses the sensed accelerator position (demanded engine torque) APS and engine speed Ne to calculate a target engine torque tTe from lookup data stored therein. The lookup data, which may be obtained experimentally, specify the target engine torque tTe as a function of accelerator position APS and engine speed Ne, as shown in the block F of FIG. 13. The control unit 30 uses the calculated target engine torque tTe and the sensed engine speed Ne to calculate a target intake air flow rate tTP" corresponding to a target air/fuel ratio from data stored therein in the form of a lookup table. The lookup data, which may be obtained experimentally, defines the target intake air flow rate tTP" as a function of target engine torque tTe and engine speed Ne, as shown in the block A of FIG. 13. It is to be understood that the target intake air flow rate tTP", which corresponds to the intake air flow rate determined to obtain a target engine torque at the target air/fuel ratio, is substantially the same as the target intake air flow rate calculated in the block C' of FIG. 7. The control unit 30 calculates a target throttle valve position tTPS from data stored therein in the form of a lookup table. The lookup data, which may be obtained experimentally, define the target throttle valve position tTPS as a function of target intake air flow rate tTP" and engine speed Ne, as shown in the block D of FIG. 13. The calculated target throttle valve position tTPS is transferred to the throttle valve drive unit 20 which thereby moves the throttle valve 18 to the calculated position tTPS so as to achieve the target intake air flow rate tTP".

The control unit 30 also uses the calculated target engine torque tTe and the sensed engine speed Ne to calculate a target equivalent ratio tDML, which corresponds to the ratio of the reference air/fuel ratio (stoichiometric air/fuel ratio) with respect to the target air/fuel ratio, from data stored therein in the form of a lookup table. The lookup data, which may be obtained experimentally, define the target equivalent ratio tDML as a function of target engine torque tTe and engine speed Ne, as shown in the block B of FIG. 13. The target equivalent ratio tDML may be corrected for the sensed coolant temperature Tw.

The control unit 30 includes a block G which produces a second target equivalent ratio tDML' having its phase delayed with respect to the target equivalent ratio tDML calculated in the block B of FIG. 13. For this purpose, the control unit 30 calculates a weighted average value of the target equivalent ratio tDML to provide a phase lag of first order to the target equivalent ratio tDML.

The control unit 30 uses the sensed engine speed Ne and intake air flow rate Q to calculate a basic value TP for fuel-injection pulse-width as TP=k·Q/Ne, as shown in the block E1 of FIG. 13, where k is a constant, Q is the intake air flow rate and Ne is the engine speed. The control unit 30 calculates the effective value TE for fuel-injection pulse-width by multiplying the calculated basic value TP by the modified target equivalent ratio tDML' and then calculate an eventual value TI for fuel-injection pulse-width by adding an ineffective pulse-width TS to the effective fuel-injection pulse-width value TE, as shown in the block E2 of FIG. 13. The calculated eventual value TI is transferred to set the fuel-injection pulse-width according to the calculated eventual value TI to operate the fuel injector 19 so as to inject fuel in such an amount as to achieve the target air/fuel ratio.

It is to be understood that the engine control unit 30 may be arranged to perform the engine torque control without the phase control made in the block G of FIG. 13.

What is claimed is:

1. An apparatus for controlling a torque produced from an internal combustion engine comprising:

a sensing section to sense engine operating conditions including an accelerator position and engine speed;

a target engine torque calculation section to calculate a target engine torque based on both the sensed accelerator position and engine speed;

a reference target intake airflow rate calculating section to calculate a reference target intake airflow rate based on the target engine torque and the engine speed;

a target air-fuel ratio calculating section to determine a target air-fuel ratio based on the target engine torque and the engine speed;

a combination section to combine the reference target intake air flow rate with the target air-fuel ratio to produce a final target intake air flow rate;

a control section to control a throttle valve to supply an amount of air flow into the engine that corresponds to the final target intake air flow rate.

2. The apparatus as claimed in claim 1, wherein both the reference target intake air flow rate calculating section and the target air-fuel ratio calculating section include a two dimensional table represented as a function of the target torque and engine speed.

3. The apparatus as claimed in claim 1, wherein the combination section further includes a section for multiplying a fuel consumption rate correction factor with the target intake air flow rate based on the calculated target equivalent ratio, the correction factor being set to decrease with the increase of the air-fuel ratio.

4. An apparatus for controlling a torque produced from an internal combustion engine comprising:

a sensing section to sense an engine operating condition including an accelerator position, engine speed and intake air flow rate;

a first control section including a throttle valve to control an amount of air permitted to enter the engine;

a second control section including a fuel injector to control an amount of fuel metered to the engine;

a target engine torque calculation section to calculate a target engine torque base on at least the accelerator position;

a target air-fuel ratio calculating section to determine a target air-fuel ratio based on the target engine torque;

a combination section to combine the target engine torque with the target air-fuel ratio to produce a target intake air flow rate;

a target fuel amount calculation section to calculate a target value for the amount of fuel based on the sensed intake air flow rate, engine speed and the target air-fuel ratio;

a target throttle valve position calculating section to calculate a target throttle valve position based on the target intake air flow rate;

a control unit to operate the first control section to control the throttle valve to allow the target air flow rate to the engine and amount of air permitted to enter the engine and to drive the second control section to provide the target fuel amount of the engine.

5. The apparatus as claimed in claim 4, wherein the target air-fuel ratio calculating section provides the target air-fuel ratio in a form of a target equivalent ratio represented by a ratio of the stoichiometric air-fuel ratio divided by the target air-fuel ratio.

6. The apparatus as claimed in claim 4, wherein the target air-fuel ratio calculating section includes a calculating section for allowing the target air-fuel ratio to undergo a first-order delay process of the target air-fuel ratio with respect to the control amount of the fuel to the engine.

7. A apparatus for controlling a torque produced from an internal combustion engine comprising:

a sensing section to sense an actual engine operating condition, the operating condition including a engine speed, intake air flow rate to the engine;

a control section including a fuel injector to control an amount of fuel metered to the engine;

a target engine torque calculation section to calculate a target engine torque corresponding to a driver's demand;

a target air-fuel ratio calculating section to determine a target air-fuel ratio based on both the target engine torque and engine speed;

a target fuel amount calculation section to calculate a target value for the amount of fuel based on the sensed actual engine operating condition and the target air-fuel ratio;

a control unit to operate the injector to supply the target fuel amount to the engine.

* * * * *